US006728975B2

(12) United States Patent
Han

(10) Patent No.: US 6,728,975 B2
(45) Date of Patent: May 4, 2004

(54) HIGH PERFORMANCE FLUSH VALVE ASSEMBLY

(75) Inventor: Joseph Unkyung Han, Irvine, CA (US)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 10/232,878

(22) Filed: Aug. 30, 2002

(65) Prior Publication Data

US 2004/0040078 A1 Mar. 4, 2004

(51) Int. Cl.[7] ..... E03D 1/34
(52) U.S. Cl. ..... 4/378; 4/390; 4/391; 4/324
(58) Field of Search ..... 4/378, 390, 391, 4/324, 325, 405

(56) References Cited

U.S. PATENT DOCUMENTS

| | | | | |
|---|---|---|---|---|
| 978,914 A | * 12/1910 | Madden | ..... | 4/390 |
| 4,604,763 A | 8/1986 | Sprang | | |
| 5,329,647 A | 7/1994 | Condon | | |
| 6,237,164 B1 | 5/2001 | LaFontaine et al. | | |

FOREIGN PATENT DOCUMENTS

| | | | | |
|---|---|---|---|---|
| FR | 2707316 A1 * | 1/1995 | ..... | 4/390 |
| GB | 2077790 A * | 12/1981 | ..... | 4/390 |

* cited by examiner

*Primary Examiner*—Gregory L. Huson
*Assistant Examiner*—Khoa Huynh
(74) *Attorney, Agent, or Firm*—Frommer Lawrence & Haug LLP; Matthew K. Ryan; Dennis M. Smid

(57) ABSTRACT

A flush valve assembly for a water tank of a water closet which includes a first valve member which can be secured to the water tank and has a base sleeve position including a radiused inlet to thereby increase the discharge coefficient of the valve opening. A second valve member is coaxially and slidably mounted with respect to the first valve member so that the valve opening is created between the first and second valve members when the second valve member is removed from the first valve member. The second valve member is slidably movable between a first rest position, wherein the second valve member is seated on the base sleeve portion of the first valve member so that water cannot pass through the valve opening, and a second position, wherein the second valve member is removed from the base sleeve portion of the first valve member so that water can pass through the valve opening. A sealing member is provided for sealing the valve opening when the second valve member is in its first rest position and seated on the base sleeve portion of the first valve member. A guiding assembly is further provided for properly guiding and aligning the second valve member with respect to the first valve member when the second valve member is moved between its first and second position. The flush valve assembly also includes a trip release mechanism is further provided for releasing the effect of the flush lever on the second valve member when the second valve member reaches its second position so as to return the second valve member to its first rest position prior to the flush lever returning to its first rest position.

30 Claims, 6 Drawing Sheets

HIGH PERFORMANCE FLUSH VALVE ASSEMBLY

FIELD OF THE INVENTION

The present invention relates to a flush valve assembly for use in a water tank of a water closet. More particularly, the present invention relates to a flush valve assembly which has a coaxial design which provides for greater energy throughput thereby causing more energy to be available to remove wastes from the toilet bowl. The greater throughput is achieved by using a greater orifice diameter and including a radius on the inlet side of the valve opening. In addition, the present invention relates in particular to a flush valve assembly having a "trip release" or "lost motion" mechanism to effectively disengage the valve opening/closing member from the flush activation member or flush lever.

BACKGROUND OF THE INVENTION

Toilets for removing waste products are well known. Typically, toilets incorporate three systems that work together to perform the flushing action. Those systems are (1) the bowl siphon, (2) the flush mechanism, and (3) the refill mechanism. Working in concert, these three systems allow the flushing function of the toilet.

Usually, the tank, positioned over the back of the bowl, contains water that is used to initiate the siphoning from the bowl to the sewage line, as well as refilling the bowl with fresh water. When a user desires to flush the toilet, the user pushes down on the flush lever on the outside of the tank, which is connected on the inside of the tank to a movable chain or lever. When the flush lever is depressed on the outside of the tank, it moves a chain or lever on the inside of the tank which acts to lift and open the flush valve, causing water to flow from the tank and into the bowl, thus initiating the toilet flush.

In many toilet designs, water flows both directly into the bowl and is dispersed into the rim of the toilet bowl. The water releases into the bowl rather quickly, with flow from the tank into the bowl typically lasting approximately two to four seconds. The water flows from the rim, down a channel within the sides of the bowl, into the large hole at the bottom of the toilet, commonly known as a siphon jet. The siphon jet releases most of the water into the siphon tube, initiating the siphon action. The siphoning action draws all the water and waste out the bowl, and into the siphon tube. The waste and water continues through the other end of the U-shaped siphon tube through an area know as the trapway, and is then released into the wastewater line connected at the base of the toilet.

Once the tank is emptied or its contents (fresh water) during the flush, the flush valve closes, and a floating mechanism, which has now dropped in the tank to some residual amount, initiates the opening of the filler valve. The filler valve provides fresh water to both the tank and the bowl through separate flows. Eventually, the tank fills with water to a high enough level to cause the float to rise, thus shutting off the filler valve. At this point, the flushing cycle is complete.

However, government agencies have continually demanded that municipal water users reduce the amount of water they use. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 now mandates that toilets sold in the United States can use water in an amount of only 1.6 gallons/flush (6 liters/flush).

In the past, toilet designs have attempted by various methods to comply with this reduced water requirement, but achieving superior flush performance has been difficult. Therefore, it has been found desirable to provide a flush valve assembly which assists the flush operation in meeting the mandated water requirements while at the same time providing for an enhanced and superior flushing operation.

In the crowded art of producing a more reliable, more efficient and more powerful 1.6 gallon (6 liter) gravity toilet, one method to more effectively remove waste from the toilet bowl is to increase the hydraulic energy available during the flushing operation. However, the hydraulic energy available is not enhanced by the typical flush valve design for a coaxial flush valve assembly wherein the effective flow diameter through the flush valve opening is less than the orifice diameter of the flush valve inlet under dynamic conditions. It has therefore been found desirable to provide a flush valve assembly wherein the effective flow diameter of the flush valve opening is close to the inlet orifice diameter under dynamic conditions so as to increase the available hydraulic energy of the flush water.

Current agency requirements further mandate that the activation means or flush lever for the flush valve assembly have a minimum "hold down" time of 1 second without exceeding the aforementioned total water usage or discharge per flush of 1.6 gallons (6 liters) of water. It has been found that the hydraulic performance characteristics of the flush valve can be significantly enhanced if water can be evacuated from the tank in a dumping time of less than 1 second, preferably 0.5–0.6 seconds. Therefore, it has been further found desirable to provide a flush valve assembly which releases the effect of the activation member or flush lever so that the valve opening can close before the expiration of the mandated minimum "hold down" time of the flush lever (1 second) without exceeding the total water per flush mandate of 1.6 gallons (6 liters).

OBJECTS AND SUMMARY OF THE INVENTION

It is a general advantage of the present invention to provide a flush valve assembly which overcomes the deficiencies of the flush valve assemblies of the known prior art.

It is also an advantage of the present invention to provide a flush valve assembly which has a greater energy throughput of the flush water in comparison to existing flush valve assemblies to thereby provide more available energy to remove waste from the toilet bowl.

It is a further advantage of the present invention to provide a flush valve assembly which permits a water closet to meet governmental agency requirements which mandate a minimum "hold-down" duration of the flush activation member or flush lever of 1 second and a maximum water usage of 1.6 gallons (6 liters) per flush.

It is yet a further advantage of the present invention to provide a flush valve assembly which includes a "trip-release" mechanism which releases the effect of the flush activation member or flush lever on closure of the valve opening so that a predetermined quantity of flush water can be delivered into the toilet bowl very quickly without exceeding mandated agency requirements.

It is still a further advantage of the present invention to provide a flush valve assembly which improves the flow characteristics of the flush water or flow capacity of the flush valve assembly.

This invention relates to a flush valve assembly for use in a water tank of a toilet bowl. This new flush valve assembly is similar to existing coaxial design flush valves used in gravity type water closet toilets which have a flush valve body usually made of plastic and constructed to form a conduit with an inlet end and an outlet end. The inlet and outlet ends allow flush water to pass from the tank or water closet area to the bowl portion of the toilet.

The flush valve assembly of the present invention allows the water tank to which it is installed to hold a predetermined volume of water and to also serve as a conduit to deliver water to the trapway via the passages within the toilet. A first valve member of the flush valve assembly of the present invention includes a base sleeve portion which is secured to the water tank or water closet and an inner cylindrical member extending generally vertically from the base sleeve portion.

A second valve member (flush valve cover or closure component) is coaxially and slidably mounted with respect to the first valve member so that a valve opening is created between the first and second valve members when the second valve member is removed from the first valve member. The second valve member is slidably movable between a first rest position, wherein the second valve member is seated on the base sleeve portion of the first valve member so that water cannot pass through the valve opening, and a second position, wherein the second valve member is removed from the base sleeve portion of the first valve member so that water can pass through the valve opening. The closed position of the valve opening prevents the flow of flush water into the valve until the valve is activated, typically by means of a flush lever assembly. The open position allows the flow of flush water to enter the valve opening and proceed into passages within the toilet to which the tank is attached.

According to one of the specific objects of the present invention, the flush valve assembly of the present invention achieves a greater energy throughput of the flush water, so as to provide more energy available to remove waste from the toilet bowl. In order to obtain this advantageous result, the base sleeve portion of the first valve member has a radiused inlet to thereby optimize venturi flow and increase the water discharge coefficient of the valve opening to approximately 0.95. More specifically, the radiused inlet has a diameter which is approximately 4.5 inches with a radius of ¾" incorporated onto the leading edge of the inlet.

In order to reduce the pulling force necessary to close and properly seal the valve opening when the second valve member is moved from its upper second position to its first rest position, an annular sealing member is provided along the outer circumferential surface of the second valve member which rests in an annular indented valve seat provided in an inner peripheral edge of the first valve member when the second valve member is in its first rest position. This annular indented valve seat preferably has a 3 inch diameter.

The second valve member is properly guided and aligned with respect to the first valve member when the second valve member is moved between its first rest and second positions by providing the flush valve assembly of the present invention with a guiding member. This guiding member includes a second cylindrical tube member secured to the second valve member which is fitted over the first cylindrical tube member of the first valve member so that the second valve member is properly guided and accurately aligned with the first valve member when the second valve member is moved between its first rest position and second position.

In order to reduce hydraulic losses and improve flow characteristics of the flush valve assembly, the first valve member also includes structure to minimize flow resistance. This flow resistance minimization member includes a plurality of tapered web members radially disposed between the first cylindrical tube member and the base sleeve position of the first valve member.

When the flush valve cover is in its floated state so that water rushes into the opened flush valve opening, water backflow has a tendency to rise in the confined space of the flush valve cover. In order to restrict further upward migration of the backflow, an annularly inclined baffle member extends from the inner peripheral surface of the outer housing of the second valve member.

Without adequate floatation of the second valve member of the flush valve assembly, the water tank will not drain properly. Therefore, in order to provide floatation of the second valve member when the second valve member is moved from its first rest position to its second position, a floatation cavity is provided in a space between downwardly depending outer wall and inner wall members of the outer housing of the second valve member.

As in typical flush valve assemblies, the second valve closure member is initially moved from its first rest position, wherein the valve opening is closed, to a second position, wherein the valve opening is opened, by means of a flush lever. This flush lever is displaceable by a user between a first rest position and a second position to operatively move the second valve member between its first rest position and its second upper position.

Current agency requirements mandate that the minimum "hold down" time for the flush lever is 1 second. However, the longer the valve opening remains open before water is evacuated from the tank, the more energy is dissipated during the flush. Therefore, in order to close the valve in less than 1 second, preferably, 0.5–0.6 seconds, and thereby ensure a relatively rapid delivery of a predetermined quantity of flush water without exceeding agency requirements, the flush valve assembly of the present invention includes a "trip-release" or "lost-motion" mechanism. This trip release mechanism releases the effect of the flush lever on the second valve member when the second valve member reaches its second upper position so as to return the second valve member to its first rest position prior to the flush lever returning to its first rest position.

In this flush valve assembly, the trip release mechanism includes a cam rod, a pull rod operatively connected to the flush lever and slidably mounted with respect to the cam rod so that the pull rod and the cam rod are movable in response to movement of the flush lever. A trip dog assembly is also incorporated in the trip release mechanism which is capable of engaging the second valve member when the pull rod and cam rod are moved between a first rest position and a second predetermined position and is capable of disengaging the second valve member when the pull rod moves beyond its second predetermined position.

The engaging and disengaging members of the trip dog assembly include wing-like retention members which extend outwardly to engage the second valve member when the pull rod is moved between its first position and the second predetermined position to move the second valve member between its first rest and second positions and which retracts when the pull rod is moved past the second predetermined position disengaging the wing-like retention members from the second valve member so as to allow the second valve member to return to its first rest position.

In order to cooperatively move the cam rod and the pull rod between their first rest and second predetermined positions, the wing-like retention members are engaged within a central depression section of the cam rod. The wing-like retention members are engaged with an annularly inclined baffle member extending from an inner peripheral surface of the outer housing of the second valve member when the pull rod is moved between its first rest position and second predetermined position. When the pull rod is moved past its second predetermined position, the wing-like retention members are retracted thereby disengaging the wing-like retention members from the annularly inclined baffle member to thereby allow the second valve member to return to its first rest position.

In addition, the central tube member of the first valve member includes an annular flange on an end thereof in order to reposition the wing-like retention members to an extended engageable position when the cam rod and pull rod are returned to their first rest position.

By including the "trip release" or "lost motion" mechanism in the present invention, the flow characteristics of a flush valve assembly are not only improved but also the flush valve assembly complies with mandated agency requirements.

Various other advantages and features of the present invention will become readily apparent from the ensuing detailed description and the novel features will be particularly pointed out in the appended claims.

BRIEF DESCRIPTION OF THE DRAWINGS

The following detailed description given by way of example, but not intended to limit the invention solely to the specific embodiments described may best be understood in conjunction with the accompanying drawings in which.

DETAILED DESCRIPTION OF CERTAIN PREFERRED EMBODIMENTS

Figure 1:
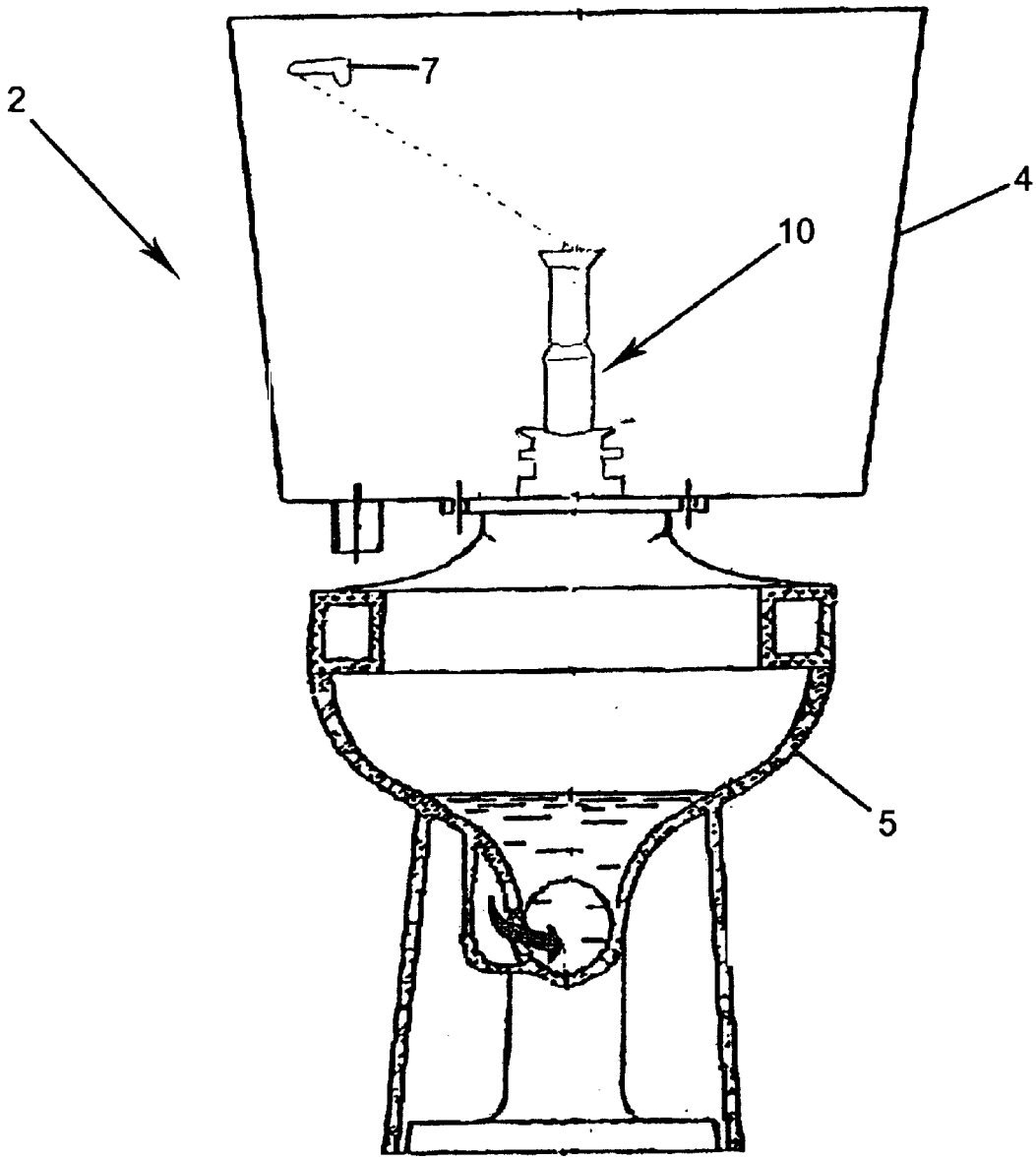
FIG. 1 is a front elevational view of a toilet incorporating the flush valve assembly of the present invention.

A flush valve assembly 10 in accordance with the teachings of the present invention is illustrated in FIG. 1 incorporated in a toilet assembly 2. As will be explained in more detail below, this flush valve assembly 10, which is provided in a water tank 4, has a greater energy throughput of the flush water in comparison to existing flush valve assemblies to thereby provide more energy available to remove waste from a toilet bowl, such as 5. In addition, this flush valve assembly permits a water closet to meet governmental agency requirements which mandate a minimum "hold-down" duration of the flush activation member or flush lever of 1 second and a maximum water usage of 1.6 gallons (6 liters) per flush. Further, this flush valve assembly improves the flow characteristics of the flush water and flow capacity of the flush valve assembly.

Figure 3:
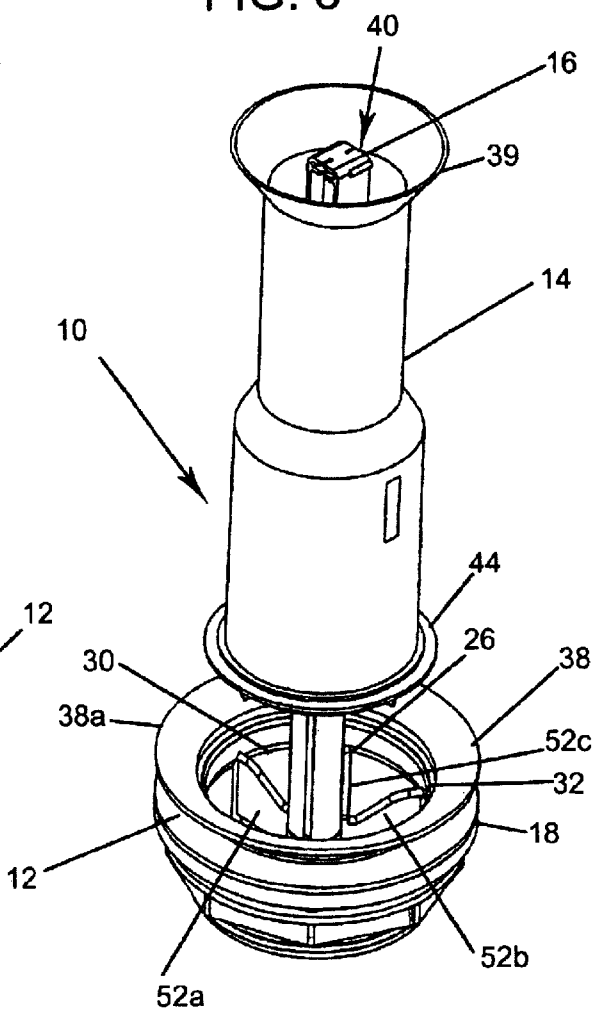
FIG. 3 is a front perspective view of the flush valve assembly of FIG. 2 with the valve opening in its open position.
Figure 2:
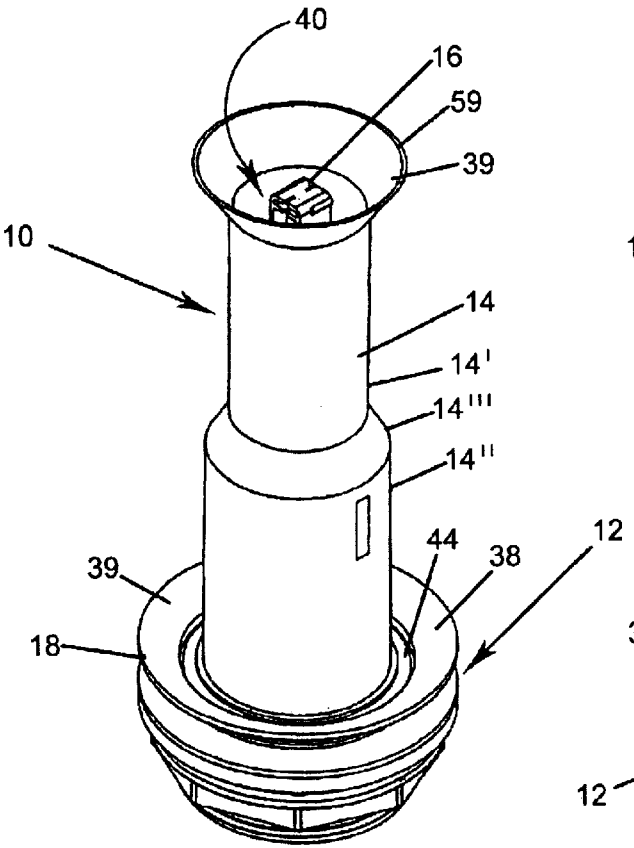
FIG. 2 is a front perspective view of a preferred embodiment of a flush valve assembly in accordance with the teachings of the present invention with the valve opening in its closed position.
Figure 4:
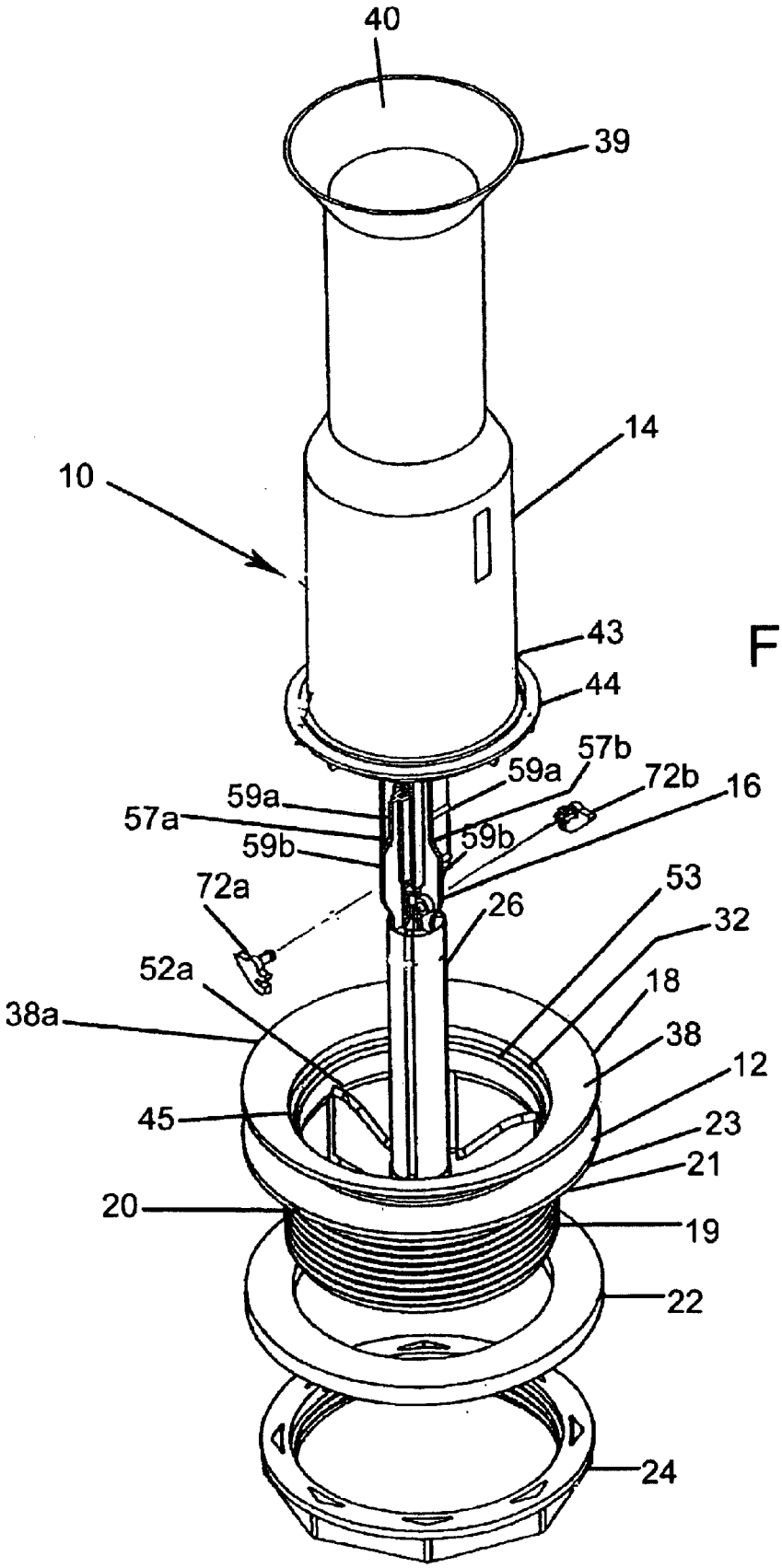
FIG. 4 is a front exploded view of the flush valve assembly of FIGS. 2–3.

As is shown in FIGS. 2 through 4, the flush valve assembly 10 of the present invention includes a valve body 12, a flush cover member 14 of a predetermined length, and a "trip-release" or "lost-motion" mechanism 16. The valve assembly 10 allows the water tank to which it is installed to hold a predetermined volume of water and to also serve as a conduit to deliver reseal water to the toilet trapway via the passages within the toilet. The valve body 12 includes a base sleeve portion 18 which is secured to the water tank or water closet by a threaded member 19 provided along the outer peripheral surface 20 of a base support portion 21 thereof.

The valve body 12 also includes a first cylindrical tube member 26 which extends vertically from the base sleeve portion 18. In order to properly seal the vent tube 12 to the water tank, a sealing member or washer 22 is fitted over the threaded member 19 so as to abut against an annular flange surface 23 of the base sleeve portion 18. A seal bearing 24 is threaded on the threaded member 19 so as to securely position the sealing member 22 between the annular flange member 23 and the sealing bearing 24 and retain the flush valve assembly to the water tank.

The flush valve cover or closure component 14 is coaxially and slidably mounted with respect to the valve body 12 so that a valve opening 30 is created between the valve body 12 and the flush valve cover 14 when the flush valve cover 14 is removed from the valve body 12. The flush valve cover 14 is slidably-movable between a first rest position, wherein the flush valve cover 14 is seated on an inner peripheral flange member 32 of the base sleeve portion 18 of the valve body 12 so that water cannot pass through the valve opening 30 (see FIGS. 2 and 6), and a second position, wherein the flush valve cover 14 is removed from the inner peripheral flange seat 32 of the base sleeve portion 18 of the valve body 12 so that water can pass through the valve opening 30 (see FIGS. 3 and 7). The closed position of the valve opening 30 prevents the flow of flush water into the valve opening until the valve is activated, by means of a flush lever 7 (see FIG. 1). The open position of the valve opening 30 allows the flow of flush water to enter the valve opening and proceed into passages within the toilet to which the water tank is attached.

As is set forth below, the flush valve assembly 10 of the present invention achieves a greater energy throughput of the flush water, which in turn generates more energy available to remove waste from the toilet bowl. In order to obtain this advantageous result, the base sleeve portion 18 of the vent tube includes a radiused inlet 38 which has a diameter a which is approximately 4.5 inches with a radius b of ¾" (see FIG. 5) incorporated onto the leading edge 38*a* of the inlet.

As a result, the radiused inlet 38 of the base sleeve portion 18 creates a discharge coefficient of the valve opening of 0.95. The discharge coefficient is the ratio between the actual flow area of the opening area and the static opening area. In practice, the higher the discharge coefficient of the opening, the greater the hydraulic energy of the water passing through the opening. Without providing a radiused inlet at the valve opening with a lead-in angle as in the present invention, the discharge coefficient of the typical prior valve opening is approximately 0.6. Accordingly, the throughput energy of the flush water passing through the valve opening of the flush valve assembly 10 of the present invention is greater than the throughput energy of the flush water passing through existing valve assemblies of the prior art as discussed above. As a result of the radiused inlet 38 of the base sleeve portion 18 of the valve body 12 as described above, the flow characteristics of the flush water and flow capacity of the flush valve assembly of the present invention are improved. Therefore, more energy is generated in the flush water passing through this flush valve assembly to remove waste in the toilet bowl.

In order to accommodate unrestricted overflow in the water tank, the flush valve cover 14 includes a funneled inlet 39 at the flush water inlet orifice 40. This funneled inlet has a predetermined lead-angle β to the horizontal axis of the flush valve cover.

As shown in the figures, especially FIG. 2, flush valve cover 14 may include an upper portion 14', a lower portion 14", and a portion 14'" located therebetween which may be a stepped or an inclined portion. The diameter of upper portion 14' may be smaller than the diameter of lower portion 14". Additionally, the annular sealing member 44 provided along the bottom surface of the flush valve cover 14 has a diameter which may be larger than that of the lower portion 14".

The inclined portion 14'" and the diameter of annular sealing member 44 may be designed and/or selected so as to enable a force to be exerted on the flush valve cover 14 during a filing operation which is sufficient to pull the flush valve cover 14 down and cause a proper seal to be formed. Such force may be the minimum force necessary to pull the flush valve cover 14 down and provide the proper seal. Additionally, the diameter of the lower portion 14" is selected so as to provide a desired buoyancy of the flush valve cover 14. Such buoyancy may affect the time period in which the flush valve cover 14 remains opened.

Thus, the flush valve cover 14 may provide a desired buoyancy and enable a minimum pulling force to be applied thereto while providing a proper sealing condition when the flush valve cover is moved to its first rest position. Furthermore, the flow characteristics of the flush water and flow capacity of the flush valve assembly 10 of the present invention are also enhanced by reducing the pulling force necessary to close and properly seal the valve opening 30 when the flush valve cover 14 is moved from its second upper position to its first rest position.

Figure 5:
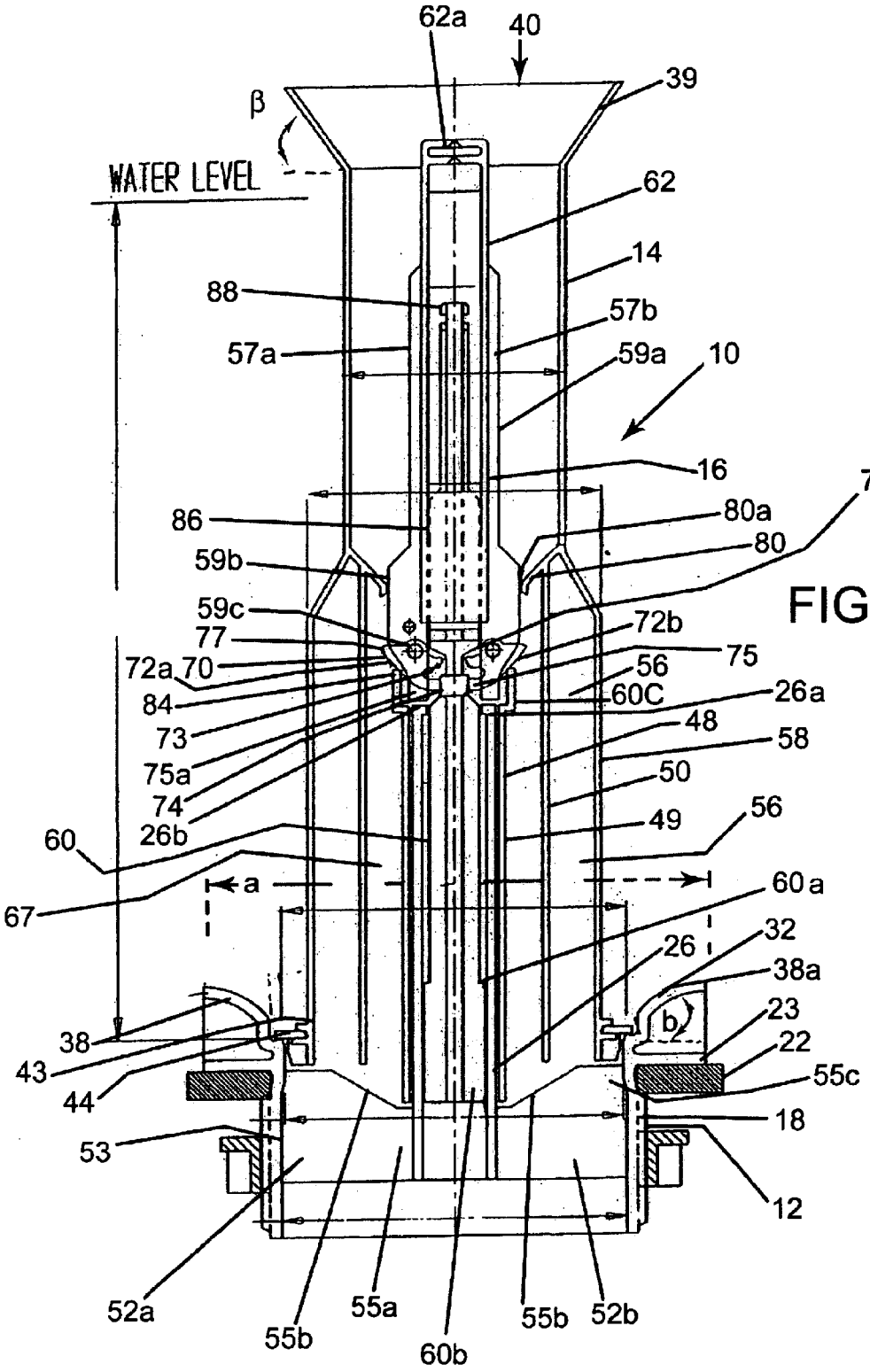
FIG. 5 is a front sectional view of the flush valve assembly of FIG. 2.

In accordance therewith, in the flush valve assembly 10 of the present invention, an annular valve seat 32 is provided downstream of the radiused inlet 38 in the valve opening 30. As best shown in FIGS. 4 and 5, the annular sealing member 44 is provided along the outer circumferential surface 43 of the flush valve cover 14 which rests in the annular indented valve seat 32 when the flush valve cover 14 is in its first rest position.

In order to properly guide and align the flush valve cover 14 with respect to the valve body 12 when the flush valve cover 14 is moved between its first rest and second upper position, the flush valve cover 14 includes a second inner cylindrical tube member 48 secured to the inner peripheral surface of an inner downwardly depending vertical wall member 50 of the flush valve cover 14 by means of a plurality of radially disposed web members (not shown) bridging the second tube member 48 between the inner wall member 50 and the second cylindrical tube member 48. The second cylindrical tube member 48 is fitted over the first cylindrical tube member 26 of the valve body 12 so that the flush valve cover 14 is properly guided and accurately aligned with the valve body 12 when the flush valve cover 14 is moved between its first rest position and second upper position.

This guiding assembly consisting of the first and second cylindrical tube members 26 and 48, respectively, also assists in properly sealing the valve opening 30 when the flush valve cover 14 is returned to its first rest position. The guiding assembly assures that the annular sealing member 44 fitted over the flush valve cover 14 is properly seated on the annular valve seat 32 of the vent tube 12 in the first rest position of the flush valve cover 14.

In order to reduce hydraulic losses and further improve flow characteristics of the flush valve assembly 10 of the present invention, the valve body 12 includes structure to minimize flow resistance. This flow resistance minimization member includes a plurality of tapered web members 52*a*, 52*b*, 52*c* radially disposed between the first cylindrical tube member 26 and a inner peripheral portion 53 of the base sleeve portion 18 of the valve body 12. As is best shown in FIG: 5, each tapered web member 52*a*, 52*b*, 52*c* is formed of a lower height section 55*a* at an end toward the first cylindrical tube member 26 which increases in height through a tapered section 55*b* until reaching extended height section 55*c* at an end toward the inner peripheral surface 53 of the base sleeve portion 18. With this design, turbulence of the flush water passing through the flush opening 30 is minimized.

When the flush valve cover is in its second (floated) position so that the flush valve opening 30 is opened, water backflow tends to migrate (rise) in the interior space of the flush valve cover 14. In order to restrict further upward migration of the backflow, an annularly inclined baffle member 80 extends from the inner peripheral surface of the second valve member 14.

In order to provide flotation of the flush valve cover 14 when the flush valve cover 14 is moved from its first rest position to its second rest position so as to achieve proper flush water drainage, a flotation cavity 56 is formed between the downwardly depending inner and outer wall members 50 and 58, respectively, of the flush valve cover 14.

As in typical flush valve assemblies, the flush valve cover 14 is initially moved from its first rest position, wherein the valve opening 30 is closed, to a second position, wherein the valve opening 30 is opened by means of a flush lever 7. This flush lever 7 is displaceable by a user between a first rest position and a second position to operatively move the flush valve cover 14 between its first rest position and second upper position. Current agency requirements mandate that the minimum "hold-down" time for the flush lever is one second. However, the longer the valve opening remains open before water is evacuated from the tank, the more energy is dissipated during the flush cycle.

The flush valve assembly of the present invention can achieve closure of the valve opening 30 in less than 1 second, preferably in 0.5–0.6 seconds, to increase the available hydraulic energy of the flush water and thereby ensure a relatively rapid delivery of a predetermined quantity of flush water without exceeding agency requirements. In accordance therewith, the flush valve assembly 10 of the present invention includes a "trip-release" or "lost-motion" mechanism 16 which, as described below, releases the effect of the flush lever on the flush valve cover 14 when the flush valve cover 14 reaches its second position so as to return the flush valve cover to its first rest position prior to the flush lever returning to its first rest position.

As is shown in the figures, the trip release mechanism 16 includes a cam rod 60, a pull rod 62 operatively connected to the flush lever at end 62*a* and slidably mounted with respect to the cam rod 60 so that the pull rod 62 and the cam rod 60 are moveable in response to movement of the flush lever. A trip dog assembly 70 is also incorporated in the trip release mechanism 16 which is capable of engaging the flush valve cover 14 when the pull rod 62 and cam rod 60 are moved between a first rest position and a second predetermined position and is capable of disengaging the flush valve cover 14 when the pull rod 62 moves beyond its second predetermined position.

As is best shown in FIGS. 4 to 8, the pull rod 60 includes a plurality of extension members, such as 57*a* and 57*b*, which includes a narrow width section 59*a* gradually increasing in width to a raised width section 59*b*. The raised width members 59*b* extend outwardly to an extent such that they can be received within a receiving opening 80*a* formed by the inner peripheral surface of an annularly inclined baffle 80, to be explained in more detail below. Each of the raised width members 59*b* include an engaging hole 59*c* at a lower end thereof.

Figure 6:
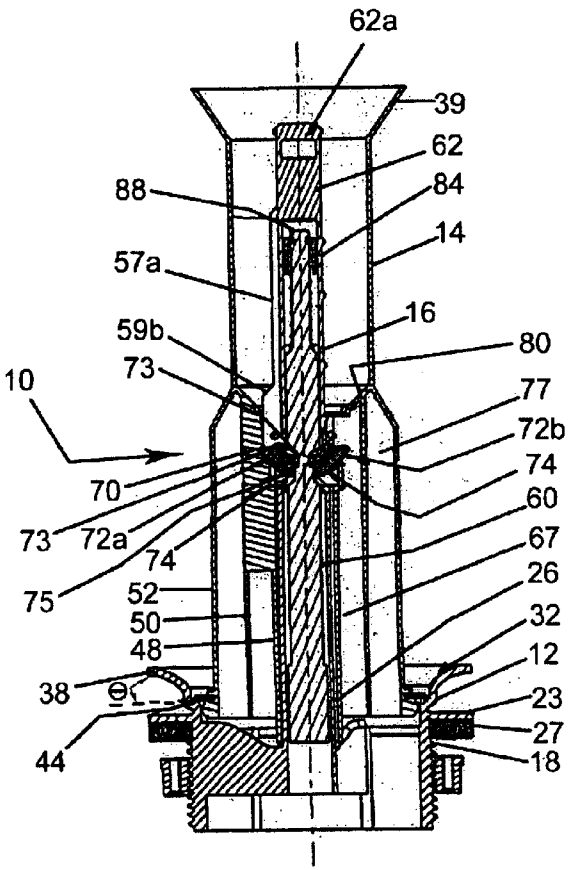
FIG. 6 is a front sectional view of the flush valve assembly of FIG. 2 with the valve opening in its closed position.
Figure 8:
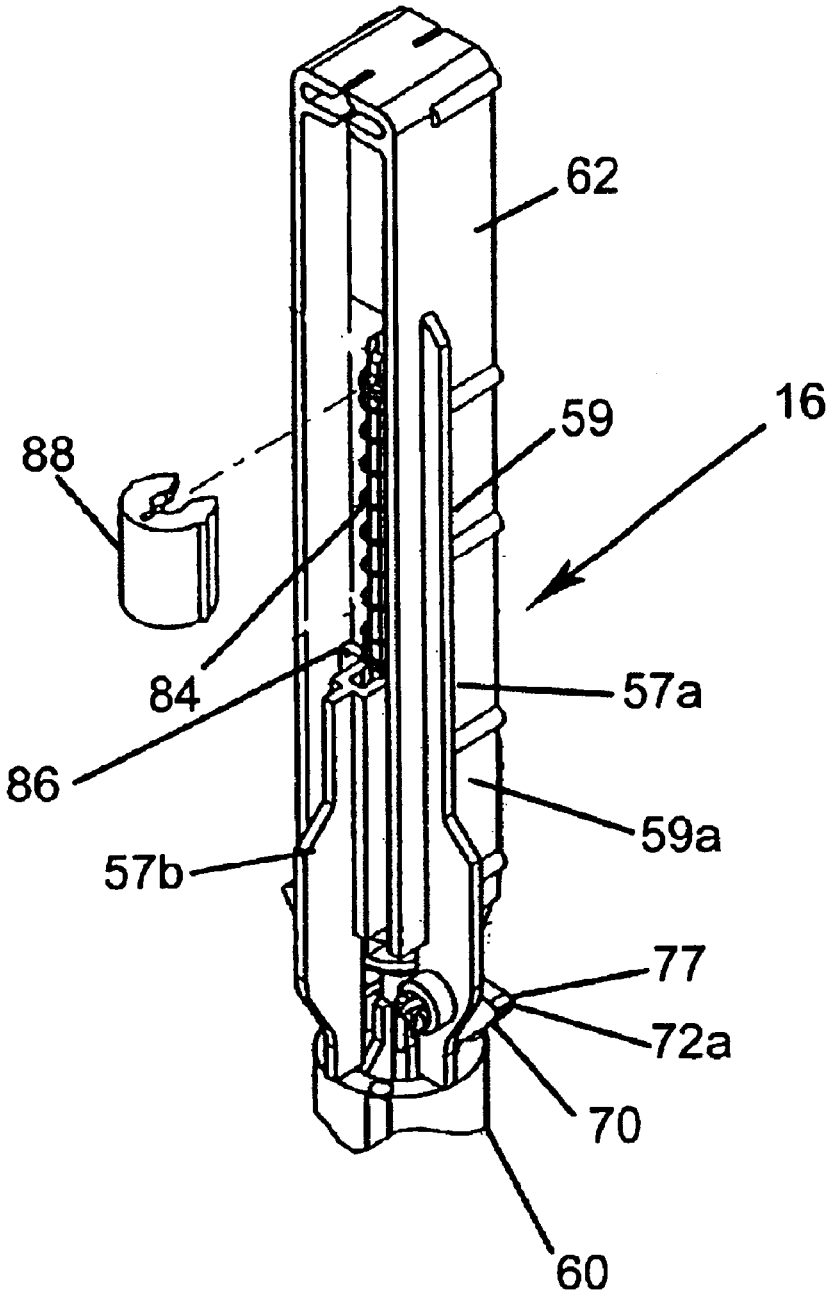
FIG. 8 is a front perspective view of the trip release mechanism of the flush valve assembly of FIGS. 2–3.

The engaging and disengaging members of the trip dog assembly 70 include wing-like retention members 72*a*, 72*b* which are supported in the engaging holes 59*c* of the raised width members 59*b* of the extension members 57*a* and 57*b*. As is shown in FIG. 6, the wing-like retention members 72*a*, 72*b* extend outwardly to engage the flush valve cover 14 when the cam rod 60 and the pull rod 62 are moved together between their first position and a second predetermined position so as to move the flush valve cover 14 between its first rest and second positions. Further movement of the cam rod 60 is restricted past this second predetermined position as will be described in further detail below. With the movement of the cam rod 60 restricted, FIG. 7 illustrates that the wing-like retention members 72*a*, 72*b* retract when the pull rod 62 is moved past its second predetermined position so as to disengage the wing-like retention members 72*a*, 72*b* from the flush valve cover 14 which in turn allows the flush valve cover 14 to return to its first rest position.

More specifically, as shown in FIG. 6, in the first rest position of the cam rod 60 and the pull rod 62, a first catch member 73 of each wing-like retention member 72*a* and 72*b* abuts against a leading inclined surface 74*a* of a central depression cam section 74 of the cam rod 60. The leading edge 75*a* of a second catch member 75 of the wing-like retention members 72*a*, 72*b* abuts against a reduced diameter section of the central depression cam section 74 of the pull rod 60.

Each of the wing-like retention members 72*a*, 72*b* further include an engagement section 77 which is pivoted to extend outwardly and be thereby repositioned when the cam rod 60 and pull rod 62 are returned to their first rest positions. As the flush lever initially moves the cam rod 60 and the pull rod 62 from their initial rest positions, the first and second catch members 73 and 75 of the wing-like retention members are contained within the central depression cam section 74 of the cam rod 60. Upon further combined movement of the cam rod 60 and pull rod 62 due to further depression of the flush lever, the engagement section 77 of each retention member 72*a* and 72*b* is engaged with an annularly inclined baffle member 80 (see FIG. 5) extending from an inner peripheral surface of the flush valve cover 14 to raise the flush valve cover 14 from its first rear position, wherein the valve opening 30 is closed, to a second upper position, wherein the valve opening 30 is opened. When the cam rod 60 and the pull rod 62 have been moved to the second predetermined height position upon depression of the flush lever, an annular base flange 60*a* provided on a base section 60*b* of the cam rod 60 abuts against an inwardly extending flange 26*a* provided at the top end 26*b* of the first cylindrical tube member 26 of the valve body 12 (see FIG. 7). This restricts further movement of the cam rod 60 with the pull rod 62 as the flush lever is further depressed.

Figure 7:
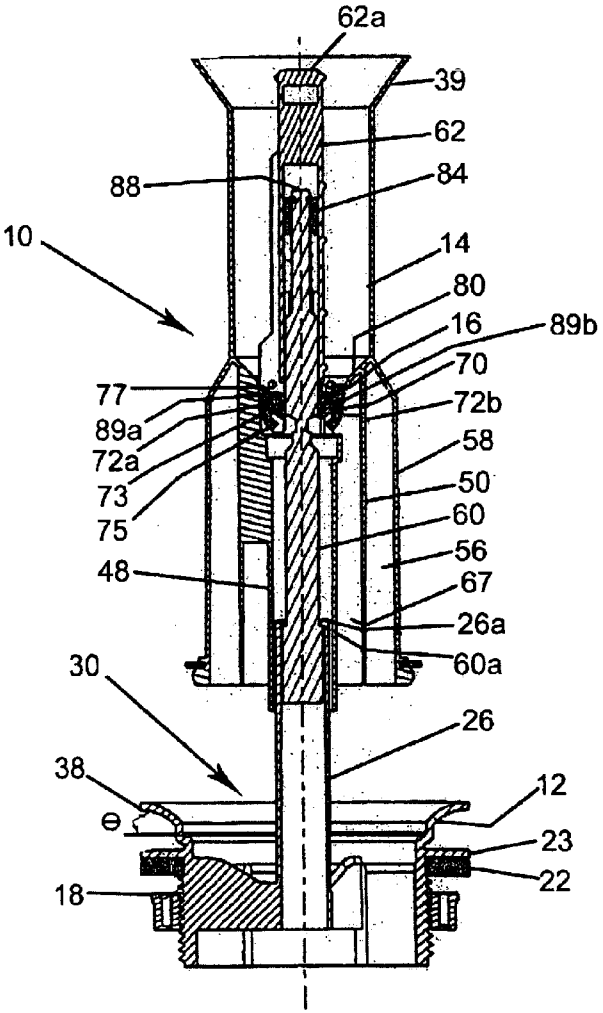
FIG. 7 is a front sectional view of the flush valve assembly of FIG. 3 with the valve opening in its open position.

When the pull rod 62 is moved past this second predetermined position by further depression of the flush lever, the pull rod is subjected to additional bias force being applied by a spring member 84 which is fitted over an upper portion of the cam rod 60 and loaded between a central core member 86 of the pull rod 62 (see FIG. 5) and a spring knob 88 provided at an upper end of the cam rod 60 (see FIGS. 6 and 7). Since the cam rod 60 is prevented from further movement, when the pull rod 62 is moved past the second predetermined height position and the biased force begins to be applied thereto, the first and second catch members 73 and 75 ride out of the central depression cam section 74 of the cam rod 60. This, in turn, causes the wing-like retention members 72*a* and 72*b* to pivot (see FIG. 7) such that the engaging section 77 of the retention members 72*a* and 72*b* are retracted toward the pull rod 62 and disengaged from the annularly inclined baffle member 80 of the flush valve cover 14. As a result, since the flush lever is connected to the pull rod, the flush valve cover 14 is no longer under the effect of the flush lever. Since the flush valve cover is unrestrained, the flush valve cover 14 is capable of returning to its first rest position. The pull rod 62 continues its upward movement past the second predetermined position until the central core member 86 abuts against the spring knob 88. At this point, further movement of the pull rod 62 is restricted.

This flushing operation causes closure of the valve opening in approximately 0.5–0.6 seconds providing a relatively quick flush operation which causes reduced energy dissipation of the flush water during the flushing operation. Even though the flush valve cover 14 returns to its first rest position to close the valve opening 30, the pull rod 62 continues to move upwardly until the flush lever has complied with its mandatory 1 second "hold-down" time.

In addition, the second cylindrical tube member 48 of the flush valve cover 14 includes an annular extended flange 84 at the upper end thereof (see FIG. 5). When the cam rod 60 and the pull rod 62 are returned to their first rest position in a subsequent flushing operation and the effect of the flush lever is released, the camming surfaces 89*a* and *b* of the retracted retention members 72*a* and 72*b* abut against the annular extended flange 84 of the second cylindrical tube member 48. As the camming surfaces 89*a* and 89*b* ride thereover, the wing-like retention members 72*a*, 72*b* are cammed to an extended engageable position so that the first catch member 73 of each wing-like retention member 72*a* and 72*b* abuts against the leading inclined surface of the central depression cam section 74 of the cam rod 60 and the wing-like retention members 72*a* and 72*b* are pivoted into a position whereby the engaging member 77 is capable of engaging the annularly inclined baffle member 80 of the flush valve cover 14 in a subsequent flush operation.

By including the "trip-release" or "lost-motion" mechanism 16 in combination with the other features set forth above, the flow characteristics of the flush water and flow capacity of the flush valve assembly are improved while at the same time compliance with mandated agency requirements is achieved.

Accordingly, for those reasons set forth above, a flush valve assembly has been designed which achieves a greater energy throughput in comparison to existing flush valve assemblies to thereby provide more flush water energy to remove waste from the toilet bowl. In addition, the flush valve assembly of the present invention permits a water closet to meet governmental agency requirements which mandate a minimum "hold-down" duration of the flush activation member or flush lever-of one second and a maximum water usage of 1.6 gallons (6 liters) per flush, but at the same time releases the effect of the flush activation member or flush lever on closure of the valve opening so that a predetermined quantity of flush water can be delivered-into the toilet bowl very quickly with little energy dissipation. Moreover, the flush valve assembly of the present invention enhances the flow characteristics and flow capacity of the flush water.

Although the invention as been particularly shown and described with reference to certain preferred embodiments, it will be readily appreciated by those of ordinary skill in the art that various changes and modifications may be made therein without departing from the spirit and scope of the invention. It is intended that the appended claims be interpreted as including the foregoing as well as various other such changes and modifications.

What is claimed is:

1. A flush valve assembly for a water tank of a water closet comprising:

a valve body having a base sleeve portion for securement to the water tank and a flush cover member which is coaxially and slidably mounted with respect to said valve body so that a valve opening is created between said valve body and said flush valve cover when the flush valve cover is not seated on the valve body; wherein said valve body is a tubular body member, and a first cylindrical tube member extends generally vertically from said base sleeve portion; and said flush cover member is slidably movable between a first rest position, wherein the flush cover member is seated on said base sleeve portion of said valve body so that water cannot pass through said valve opening, and a second position, wherein the flush cover member is removed from said base sleeve portion of said valve body so that water can pass through said valve opening;

sealing means for sealing the valve opening when said flush cover member is in its said first position and seated on said base sleeve portion of said valve body; and guiding means for properly guiding and aligning said flush cover member with respect to said valve body when said flush cover member is moved between said first and second positions;

wherein said base sleeve portion of said valve body has an inlet at said valve opening with a radius incorporated onto a leading edge of said inlet to provide a lead-in angle and to thereby increase the water discharge coefficient of the valve opening, and an annular indented valve seat provided in an inner peripheral edge thereof on which said sealing means rests when said flush cover member is in its said first rest position; and wherein said guiding means includes a second cylindrical tube member secured to said flush cover member which is slidably fitted over said first cylindrical tube member so that said flush cover member is properly guided and accurately aligned with said valve body when said flush cover member is moved between its said first and second positions.

2. The flush valve assembly of claim 1 wherein said inlet of said base sleeve portion achieves a discharge coefficient of approximately 0.95.

3. The flush valve assembly of claim 1 wherein said inlet has a diameter which is approximately 4.5 inches.

4. The flush valve assembly of claim 1 wherein said annular indented valve seat has an annular diameter of approximately 3 inches.

5. The flush valve assembly of claim 1 wherein said valve body includes means for minimizing flow resistance.

6. The flush valve assembly of claim 5 wherein said flow resistance minimization means includes a plurality of tapered web members radially disposed between said first cylindrical tube member and said base sleeve portion.

7. The flush valve assembly of claim 1 wherein said flush cover member includes means for restricting upward backflow migration when said flush cover member is initially moved from said first rest position to said second position when said valve opening begins to open.

8. The flush valve assembly of claim 7 wherein said backflow restriction means includes an annularly inclined baffle member extending from an inner perpheral surface of said flush cover member.

9. The flush valve assembly of claim 1 wherein said flush cover member includes means for providing floatation of said flush cover member when said flush cover member is moved from first rest position to said second position.

10. The flush valve assembly of claim 9 wherein said floatation means comprises a floatation cavity being provided in a space between an outer wall member and an inner wall member of said flush cover member.

11. A flush valve assembly for a water tank of a water closet comprising:

a valve body which can be secured to the water tank and has a base sleeve portion;

a flush cover member which is coaxially and slidably mounted with respect to said valve body so that a valve opening is created between said valve body and said flush cover member when said flush cover member is removed from said valve body, said flush cover member being slidably movable between a first position, wherein the flush cover member is seated on the base sleeve portion of the valve body so that water cannot pass through said valve opening, and a second position, wherein the flush cover member is removed from said base sleeve portion of said valve body so that water can pass through said valve opening;

a flush lever displaceable for a user between a first rest position and a second position to operatively move said flush cover member between its first rest position and said second position; and trip release means for releasing the effect of said flush lever on said flush cover member when said flush cover member reaches said second position so as to return to said flush cover member to said first rest position prior to said flush lever returning to said first rest position;

wherein said trip release means is a trip release mechanism coaxially mounted with respect to said valve body and said flush cover member, said trip release mechanism including a cam rod; a pull rod operatively connected to said flush lever and slidably mounted with respect to said cam rod so that said pull rod and said cam rod are movable in response to movement of said flush lever; and a trip dog assembly including means for engaging said flush cover member when said pull rod and cam rod are moved between a first rest position and a second predetermined position, and means for disengaging said flush cover member when said pull rod moves beyond its second predetermined position;

wherein said cam rod of said trip release mechanism is mounted within a guide tube of said valve body; and wherein said guide tube of said valve body includes an inwardly extending annular flange member to restrict movement of said cam rod past its second predetermined position.

12. The flush valve assembly of claim 11 wherein said flush cover member engaging and disengaging means of said trip dog assembly includes wing-like retention members which extend outwardly to engage said flush cover member when said pull rod is moved between its said first position and said second predetermined position to move said flush cover member between its said first rest and second positions and which retracts when said pull rod is moved past said second predetermined position, disengaging said wing-like retention members from said flush cover member so as to allow said flush cover member to return to its said first rest position.

13. The flush valve assembly of claim 12 wherein said wing-like retention members are engaged with an annularly inclined baffle member extending from an inner peripheral surface of an outer housing of said flush cover member when the pull rod is moved between its said first rest position and second predetermined position.

14. The flush valve assembly of claim 13 wherein when said pull rod is moved past said second predetermined position, said wing-like retention members are retracted, thereby disengaging said wing-like retention members from said annularly inclined baffle member to thereby allow said flush cover member to return to its said first rest position.

15. The flush valve assembly of claim 12 wherein said wing-like retention members are engaged within a central depression section of said cam rod so as to cooperatively move said cam rod and said pull rod between their said first and second predetermined positions.

16. The flush valve assembly of claim 12 wherein said flush cover member includes a central guiding tube which assists in properly aligning said flush cover member with respect to said valve body during movement of said flush cover member between its said first rest position and its second position, said central guiding tube having an annular flange on an end thereof which repositions said wing-like retention members to an extended engageable position when the cam rod and pull rod are returned to their first rest position.

17. The flush valve assembly of claim 11 wherein said pull rod is spring loaded with respect to said cam rod.

18. A flush valve assembly for a water tank of a water closet comprising:

a valve body which can be secured to the water tank and having a base sleeve portion;

flush cover member which is coaxially and slidably mounted with respect to said valve body so that a valve opening is created between said valve body and said flush cover member when the flush cover member is removed from said valve body; said base sleeve portion of said valve body having an inlet at said valve opening with a radius incorporated onto a leading edge of said inlet to provide a lead-in angle and to thereby increase the water discharge coefficient; said flush cover member being slidably movable between a first rest position, wherein the flush cover member is seated on said base sleeve portion of said valve body so that water cannot pour through said valve opening; and a second position, wherein the flush cover member is removed from said base sleeve portion of said valve body so that water can pass through said valve opening;

sealing means for sealing the valve opening when said flush cover member is in its said first rest position and seated on said base sleeve portion of said valve body;

guiding means for properly guiding and aligning said flush cover member with respect to said valve body when said flush cover member is moved between its said first and second positions;

a flush lever displaceable by a user between a first rest position and a second position to operatively move said flush cover member between its said first rest position and said second position; and trip release means for releasing the effect of said flush lever on said flush cover member when said flush cover member reaches its said second position so as to return said flush cover member to its said first rest position prior to said flush lever returning to its said first rest position, said trip release means being a trip release mechanism that is coaxially mounted with respect to said valve body and said flush cover member; said trip release mechanism including a cam rod; a pull rod operatively connected to said flush lever and slidably mounted with respect to said cam rod so that said pull rod and said cam rod are movable in response to movement of said flush lever; and a trip dog assembly including means for engaging said flush cover member when said pull rod and cam rod are moved between a first rest position and a second predetermined position, and means for disengaging said flush cover member when said pull rod moves beyond its said second predetermined position; and wherein said engaging and disengaging means of said trip dog assembly includes wing-like retention members which extend outwardly to engage said flush cover member when said pull rod is moved between its said first position and said second predetermined position to move said flush cover member between its said rest and second positions and which retracts when said pull rod is moved past said second predetermined position, disengaging said wing-like retention members from said flush cover member so as to allow said flush cover member to return to its said first rest position.

19. The flush valve assembly of claim 18 wherein said inlet of said base sleeve portion of said valve body achieves a discharge coefficient of the valve opening of approximately 0.95.

20. The flush valve assembly of claim 18 wherein said inlet has a diameter which is approximately 4.5 inches.

21. The flush valve assembly of claim 18 wherein said base sleeve portion of said valve body includes an annular indented valve seat in an inner peripheral edge thereof on which said sealing means rests when said flush cover member is in its said first rest position.

22. The flush valve assembly of claim 21 wherein said annular indented valve seat has an annular diameter of approximately 3 inches.

23. The flush valve assembly of claim 18 wherein said valve body includes a first cylindrical tube member extending generally vertically from said base sleeve portion thereof.

24. The flush valve assembly of claim 23 wherein said guiding means includes a second cylindrical tube member secured to said flush cover member and slidably fitted over said first cylindrical tube member so that said flush cover member is properly guided and accurately aligned with said valve body when said flush cover member is moved between its said first and second positions.

25. The flush valve assembly of claim 18 wherein said flush cover member includes means for restricting backflow migration when said flush cover member is initially moved from its said first rest position to its second position when said valve opening begins to open.

26. The flush valve assembly of claim 25 wherein said backflow restriction means includes an annularly inclined baffle member extending from an inner peripheral surface of the outer housing of said flush cover member.

27. The flush valve assembly of claim 18 wherein said flush cover member includes means for providing floatation of said flush cover member when said flush cover member is moved from its said first rest position to its said second position.

28. The flush valve assembly of claim 27 wherein said flotation means comprises a floatation cavity being provided between an outer wall member and an inner wall member of said flush cover member.

29. The flush valve assembly of claim 18 wherein said wing-like retention members are engaged with an annularly inclined baffle member extending from an inner peripheral surface of an outer housing of said flush cover member when the pull rod is moved between its said first rest position and second predetermined position.

30. The flush valve assembly of claim 29 wherein when said pull rod is moved past said second predetermined position, said wing-like retention members are retracted, thereby disengaging said wing-like retention members from said annularly inclined baffle member to thereby allow said flush cover member to return to its said first rest position.

* * * * *